US010724814B2

(12) United States Patent
Thomele et al.

(10) Patent No.: US 10,724,814 B2
(45) Date of Patent: Jul. 28, 2020

(54) HANDGUN SAFETY MECHANISM

(71) Applicant: Sig Sauer, Inc., Newington, NH (US)

(72) Inventors: Adrian Thomele, Stratham, NH (US); Jason Knight, Exeter, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/229,843

(22) Filed: Dec. 21, 2018

(65) Prior Publication Data

US 2019/0195587 A1 Jun. 27, 2019

Related U.S. Application Data

(60) Provisional application No. 62/609,971, filed on Dec. 22, 2017.

(51) Int. Cl.

| | |
|---|---|
| ***F41A 17/60*** | (2006.01) |
| ***F41A 11/00*** | (2006.01) |
| ***F41A 17/56*** | (2006.01) |
| *F41A 17/30* | (2006.01) |

(52) U.S. Cl.

CPC ..... *F41A 17/60* (2013.01); *F41A 11/00* (2013.01); *F41A 17/56* (2013.01); *F41A 17/30* (2013.01)

(58) Field of Classification Search

CPC ..... F41A 17/60; F41A 17/68
USPC ..... 42/108
See application file for complete search history.

(56) References Cited

U.S. PATENT DOCUMENTS

| | | | | |
|---|---|---|---|---|
| 4,593,601 | A | 6/1986 | Smith | |
| 6,401,379 | B1 | 6/2002 | Moon | |
| D598,065 | S | 8/2009 | Vukovic et al. | |
| D654,978 | S | 2/2012 | Karanian et al. | |
| 8,371,058 | B2 * | 2/2013 | Trpcic | F41A 17/56 42/108 |
| D681,131 | S | 4/2013 | Su | |
| 8,448,364 | B2 | 5/2013 | Davidson | |
| D690,374 | S | 9/2013 | Lee | |
| D692,513 | S | 10/2013 | Yigit | |
| 9,021,730 | B2 | 5/2015 | Gentilini et al. | |
| D744,049 | S | 11/2015 | Chu | |
| 9,194,654 | B1 | 11/2015 | Viani | |
| D754,802 | S | 4/2016 | Martelli et al. | |
| 9,303,936 | B2 | 4/2016 | Toner | |
| D755,324 | S | 5/2016 | Martelli et al. | |
| D755,907 | S | 5/2016 | Hu | |
| D758,519 | S | 6/2016 | Toner et al. | |
| 9,441,897 | B2 | 9/2016 | Mather et al. | |
| 9,546,831 | B2 | 1/2017 | Bandini et al. | |

(Continued)

OTHER PUBLICATIONS

"Instruction Manual for Ruger American Pistol Pro Model", Sturm, Ruger & Co., Inc. (2016). 43 pages.

(Continued)

*Primary Examiner* — Reginald S Tillman, Jr.
(74) *Attorney, Agent, or Firm* — Finch & Maloney PLLC

(57) ABSTRACT

A takedown lever assembly for a striker-fired handgun. The takedown lever assembly includes a takedown actuation lever operable between a firing position and a takedown position, and a safety bar operatively coupled to the takedown actuation lever. The safety bar moves longitudinally along the frame in response to moving the takedown actuation lever from the firing position to the takedown position, thereby causing the sear to disengage from the striker.

22 Claims, 7 Drawing Sheets

(56) References Cited

U.S. PATENT DOCUMENTS

| | | | |
|---|---|---|---|
| 9,551,550 | B2 | 1/2017 | Wells |
| 9,664,471 | B1 | 5/2017 | Curry et al. |
| D791,262 | S | 7/2017 | Brown et al. |
| D803,341 | S | 11/2017 | Wolfe |
| D808,487 | S | 1/2018 | Beville et al. |
| D814,593 | S | 4/2018 | O'Clair et al. |
| D814,596 | S | 4/2018 | Curry |
| D815,233 | S | 4/2018 | Toner et al. |
| D823,969 | S | 7/2018 | Beville et al. |
| D828,881 | S | 9/2018 | Lee |
| D828,892 | S | 9/2018 | Kellgren |
| D830,480 | S | 10/2018 | Chu |
| 10,088,269 | B2 | 10/2018 | Sheets, Jr. et al. |
| D834,656 | S | 11/2018 | Chu |
| 10,180,298 | B2 | 1/2019 | Noonan |
| 2001/0037596 | A1 | 11/2001 | Salvitti |

OTHER PUBLICATIONS

"Instruction Manual for Ruger American Pistol, Standard Model", Sturm, Ruger & Co., Inc. (2016). 44 pages.
Ruger American Pistol Pro Model Parts List, pp. 34-37 (2016).

* cited by examiner

HANDGUN SAFETY MECHANISM

RELATED APPLICATIONS

This application claims priority under 35 U.S.C. § 119(e) to U.S. Provisional Patent Application No. 62/609,971 titled HANDGUN SAFETY MECHANISM and filed on Dec. 22, 2017, the contents of which are incorporated herein by reference in its entirety.

FIELD OF THE DISCLOSURE

This disclosure relates to projectile weapons and more particularly to a safety mechanism for handguns.

BACKGROUND

Firearms design involves many non-trivial challenges. Traditionally, semiautomatic handguns have been made with a metal frame that includes the grip. The grip portion of the frame defines a magazine well into which a magazine is installed. A slide mounts to and slides longitudinally along rails along the top of the frame as the action is cycled. The frame defines an open region adjacent and above the magazine well for the fire control group. Components of the fire control group are installed in the frame, often with a pin that extends laterally through the frame. More recently, the semiautomatic pistol has been made with a polymer grip module that defines a frame well for a separate metal frame that houses the fire control group. The frame can be installed into the grip module and may include rails for the slide. Rather than a hammer that impacts a firing pin, striker-fired handguns have a striker that is cocked and then released forward to strike the ammunition primer upon pulling the trigger.

SUMMARY

Embodiments of the present disclosure are directed to a handgun having improved safety features. One aspect of the present disclosure relates to a slide catch lever that operates with the takedown lever to require a safe takedown sequence by the user. Another aspect of the present disclosure relates to a takedown lever assembly that requires an empty magazine well before the lever can be moved to the takedown position. Another aspect of the present disclosure relates to a takedown lever that de-cocks the striker when the takedown actuation lever is moved to the takedown position. A further aspect of the present disclosure is directed to a handgun in combination with one or more aspects mentioned above. A still further aspect of the present disclosure is directed to a retrofit kit for a handgun. Numerous embodiments will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
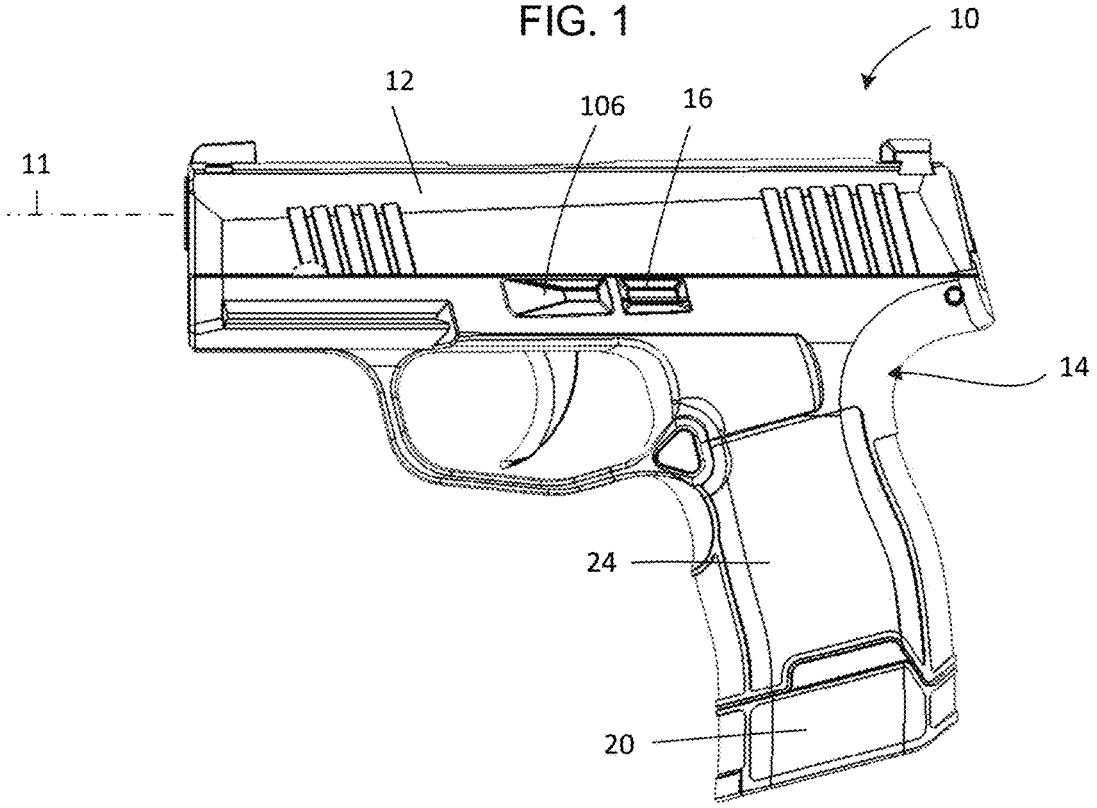
FIG. 1 illustrates a left-side elevational view of a handgun with a takedown actuation lever and shows the slide in the closed position, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

Safety has been an important challenge for firearms designers. Handguns can be made with external safety levers that are activated by the user and internal safeties to prevent discharge when the firearm is dropped. Some semiautomatic, hammer-fired handguns are configured for double-action and single-action firing (DA/SA). In a double action pistol, pulling the trigger can first cock the hammer and then release the hammer to impact the firing pin. In a single action pistol, pulling the trigger only releases a cocked hammer. Such DA/SA handguns often lack an external safety lever, but instead use the increased trigger pull weight in double action configuration (~12 lbs. vs. ~4.5 lbs.) as one type of safety mechanism. The increased trigger pull force in double action is generally sufficient to avoid inadvertently firing the handgun due to a drop or to bumping the trigger. DA/SA handguns often include a de-cocking lever. From a cocked state, the user can press the de-cocking lever to lower the hammer to a de-cocked state prior to placing the firearm in a holster or unloading the ammunition.

With the advent of striker-fired pistols, the DA/SA fire control group with a firing pin and hammer has been replaced by a single-action-only (SAO) fire control group that includes a striker held by spring force until released by pulling the trigger to release the striker forward and impact the ammunition primer. One advantage of striker-fired handguns is a consistent and short trigger pull for every shot. For some users who carry their firearms concealed, another advantage of striker-fired handguns is the lack an external hammer that can snag on clothing. Striker-fired handguns lack a de-cocking lever and many manufacturers have also removed external safety levers. The result is a generally sleek handgun with few external controls that requires fewer steps to fire the gun. After chambering a round, the handgun is cocked and ready to fire, where pulling the trigger will discharge the firearm. When the user wishes to clean or service the firearm according to proper safety protocol, the user first releases the magazine from the magazine well, followed by racking the slide to eject the chambered round (if present), checking the gun to ensure no ammunition is present, and then pulling the trigger full cycle to release the spring tension on the striker. The user may now disassemble or "take down" the handgun for cleaning or service.

One non-trivial issue of firearms design and performance pertains to safe operation of the handgun while firing and while servicing the handgun. In recent years, incidents of accidental discharge have occurred during the course of cleaning striker-fired handguns. When proper takedown protocol is followed, cleaning and servicing the firearm is a safe event. Unfortunately, however, gun owners who do not follow proper protocol can experience unintentional discharges. For example, after releasing the magazine, the user pulls the trigger to decock the striker without first racking the slide back to clear the ammunition and then confirm a clear chamber. If a round is still in the chamber in such a situation, a shot is fired when the user pulls the trigger. Accordingly, the need to pull the trigger during the takedown process has raised a safety concern in striker-fired handguns.

The present disclosure relates to a safety mechanism for semiautomatic handguns. One aspect of the disclosure is directed to a takedown lever assembly useful in striker-fired handguns and other firearms.

General Overview

In one aspect, the present disclosure relates to a takedown lever assembly that releases the striker when the takedown lever is moved to the takedown position. The present disclosure also relates to a semiautomatic handgun and a handgun frame having a takedown lever assembly with a safety bar.

In one embodiment, the takedown lever assembly decocks the striker when the takedown actuation lever is moved to the takedown position. For example, the takedown lever assembly includes a takedown actuation lever and a safety bar extending longitudinally between the takedown actuation lever and the sear or other component of the fire control group. Moving the takedown actuation lever from a first position (e.g., a firing position) to a second position (e.g., a takedown position) causes the safety bar to move along the frame in a direction generally parallel to the bore axis and causes the sear to disengage from the striker.

In some embodiments, the takedown safety bar can include a catch extending laterally and configured to engage a component of the fire control group, such as the sear or a sear actuator. In accordance with one embodiment, moving the takedown actuation lever to the takedown position moves the safety bar distally. As a result, for example, the catch on the safety bar engages the sear and rotates the sear out of engagement with the striker. In some embodiments, the takedown safety bar directly engages the sear to pivot the sear out of engagement with the striker; in other embodiments, the takedown safety bar indirectly acts on the sear by engaging a sear actuator or other component functionally connected to the sear. In accordance with some embodiments, the takedown lever assembly eliminates the need for the user to pull the trigger during the takedown process, therefore improving safety.

In some embodiments, the safety bar also includes a protrusion that extends into the magazine well when the takedown actuation lever is in the takedown position. As a result, the takedown actuation lever is prevented from moving to the takedown position when a magazine occupies the magazine well. Conversely, a magazine cannot be seated in the magazine well when the takedown actuation lever is in the takedown position since the protrusion obstructs the magazine's path into the magazine well.

In some embodiments, the handgun includes features on the takedown actuation lever and/or the slide so that the takedown actuation lever can be rotated to the takedown position only when the slide is in the rearward open position (e.g., slidelock). For example, the slide includes a recess along the slide rail that provides clearance for rotation of the lever wing of the takedown actuation lever. The recess is positioned so that it aligns with the takedown actuation lever when the slide is in the open position. Accordingly, prior to moving the takedown actuation lever to the takedown position, the slide must be moved rearward to the open position, thereby ejecting a chambered round if present.

A takedown lever assembly according to some embodiments of the present disclosure advantageously improves safety of striker-fired handguns by requiring the user to perform a series of actions in the takedown process. For example, the user must remove the magazine and clear ammunition from the chamber prior to takedown of the firearm for cleaning or service. At the same time, the takedown lever assembly can function to release the striker from spring tension in lieu of the user pulling the trigger to do so. These features, together or independently, can reduce or eliminate unintentional discharge of the handgun during the takedown process. Numerous configurations and variations will be apparent in light of this disclosure.

As will be appreciated in light of this disclosure, and in accordance with some embodiments, a takedown lever assembly and its components can be used with striker-fired and other semiautomatic handguns in accordance with present disclosure. In accordance with some example embodiments, a takedown lever assembly can be provided as part of a semiautomatic handgun chambered in .22 LR, .380 Auto, 9 mm Luger, .357 SIG, 10 mm Auto, .40 S&W, .45 ACP ammunition, or any other suitable ammunition. It is contemplated that the takedown lever assembly of the present disclosure could also be used in other firearms, including but not limited to long guns and submachine guns. Other suitable host firearms will be apparent in light of this disclosure.

In accordance with some embodiments, the disclosed apparatus may be detected, for example, by visual inspection of a handgun or other firearm having features such as a takedown lever assembly that decocks the striker or otherwise releases the spring tension on the striker when the takedown lever is moved to the takedown position; a takedown actuation lever with a recess and/or catch surface to engage a safety bar connected between the takedown actuation lever and the fire control group; a safety bar displaceable along the frame due to rotation of the takedown actuation lever; and/or a safety bar actuated by the takedown actuation lever and having a protrusion that extends into the magazine well when the takedown actuation lever is in the takedown position.

As used herein, the term "frame" refers to the serialized component of a handgun that houses components of the fire control assembly. In metal handguns, for example, the frame may include the grip portion, trigger guard, and a portion of the frame that extends along the bottom of the barrel. In handguns having a polymer grip module, for example, the frame is the metal, serialized component that can be secured into the open top portion of the grip module and along which the slide reciprocates.

While generally referred to herein as a takedown lever assembly for consistency and ease of understanding the present disclosure, the disclosed takedown lever assembly and its components are not limited to that specific terminology and alternatively can be referred to using other terms. For example, the takedown actuation lever alternately can be referred to as a takedown lever, a takedown tab, or other terms. In another example, the lever wing can alternately be referred to as the takedown lever handle or other terms. In yet another example, the safety bar can alternately be referred to as a takedown safety lever, a takedown safety, a safety linkage, or other terms. As will be further appreciated, the particular configuration (e.g., materials, dimensions, etc.) of a takedown lever assembly configured as described herein may be varied, for example, depending on whether the intended use is military, tactical, sport, or civilian in nature. Numerous configurations will be apparent in light of this disclosure.

Structure and Operation

Figure 2:
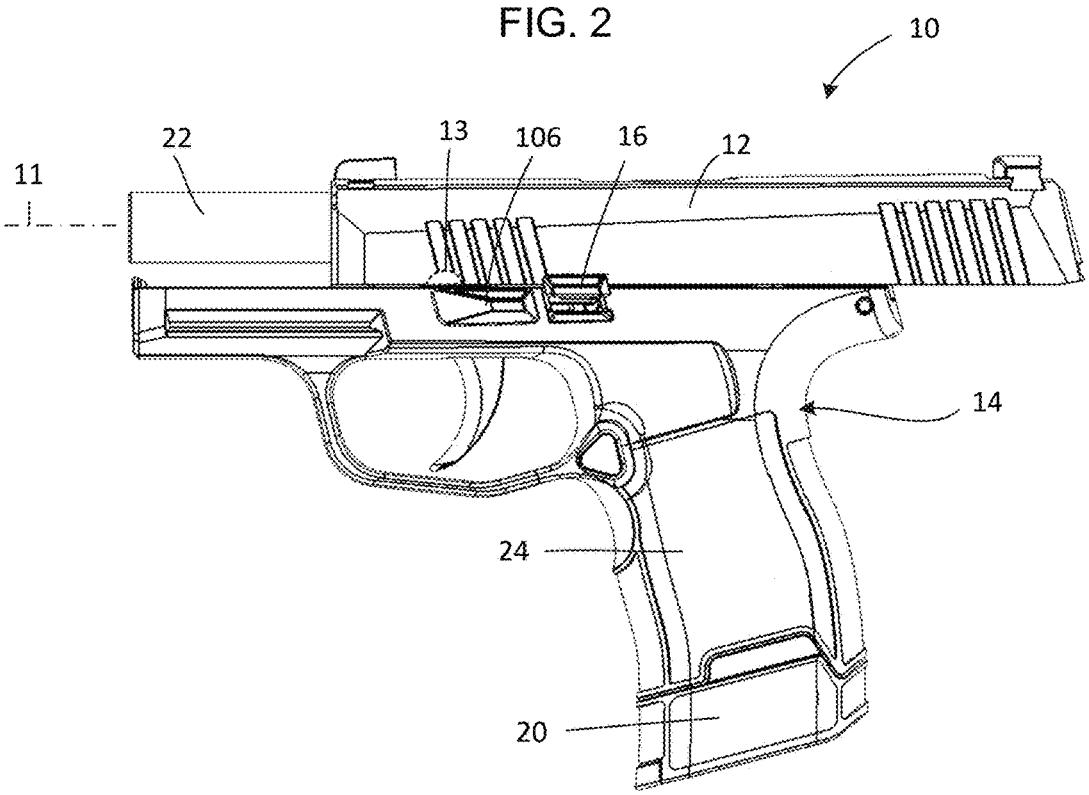
FIG. 2 illustrates a left-side elevational view of the handgun of FIG. 1 showing the slide locked open in the slidelock position, in accordance with an embodiment of the present disclosure.

Example embodiments of the present disclosure are illustrated in FIGS. 1-11. Referring to FIGS. 1-2, a left-side elevational view illustrates an example of a semiautomatic handgun 10 in accordance with an embodiment of the present disclosure. Handgun 10 has a slide 12 that is displaceable along a frame 50 (shown, e.g., in FIG. 3) in a direction generally parallel to a bore axis 11. A takedown actuation lever 106 is shown in the first position or firing position. When takedown actuation lever 106 is in the firing position, slide 12 can move between the closed position (as shown in FIG. 1) and the open position (shown in FIG. 2) as the action is cycled by firing or cycled manually to clear the chamber, for example. Slide 12 can also be locked in the open position (i.e., the "slidelock" position) by moving a slidelock lever 16 up to engage a catch in slide 12 as shown, for example, in FIG. 2. Slide 12 optionally defines a lever wing recess 13 positioned to provide clearance for rotation of takedown actuation lever 106 when slide 12 is in the slidelock position. A magazine 20 is installed in a magazine well defined in the grip portion 24 of grip module 14.

Figure 3:
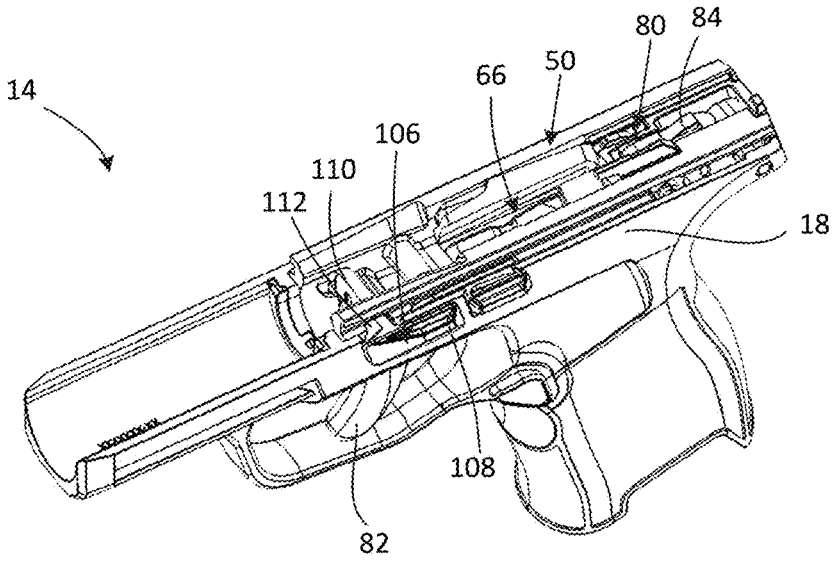
FIG. 3 illustrates a top and left-side perspective view of a grip module of the handgun of FIG. 1 showing a frame disposed in the open top portion of the grip module and housing a fire control group, in accordance with an embodiment of the present disclosure.

FIG. 3 illustrates a top and left-side perspective view of grip module 14 of handgun 10 with a frame 50 disposed in an open top portion 18 of grip module 14. Frame 50 houses a fire control group 80, which includes a trigger 82 and a sear 84. Takedown actuation lever 106 includes a takedown lever shaft 110 that extends laterally through grip module 14 and frame 50 generally perpendicular to bore axis 11 (shown in FIGS. 1-2). Takedown actuation lever 106 also includes a lever wing 108 connected to first end 112 of takedown lever shaft 110 and extending generally perpendicularly from lever shaft 110 along an outside of grip module 14. Lever wing 108 is configured to be operable by the user to move takedown actuation lever 106 between the firing position and the takedown position.

In some embodiments, an upper distal portion 109 (e.g., an upper distal corner) of lever wing 108 extends distally of takedown lever shaft 110 when takedown actuation lever 106 is in the firing position. As such, upper distal portion 109 rotates into the path of slide 12 when takedown actuation lever 106 is rotated to the takedown position. When slide 12 is in the closed position, takedown actuation lever 106 cannot be rotated to the takedown position due to interference between slide 12 and lever wing 108. However, when slide 12 is moved to the slidelock position as shown in FIG. 2, for example, lever wing recess 13 formed in slide 12 provides clearance for upper distal portion 109 during rotation of lever wing 108, therefore permitting rotation of takedown actuation lever 106 to the takedown position. Takedown actuation lever 106 is discussed in more detail below.

Figure 4:
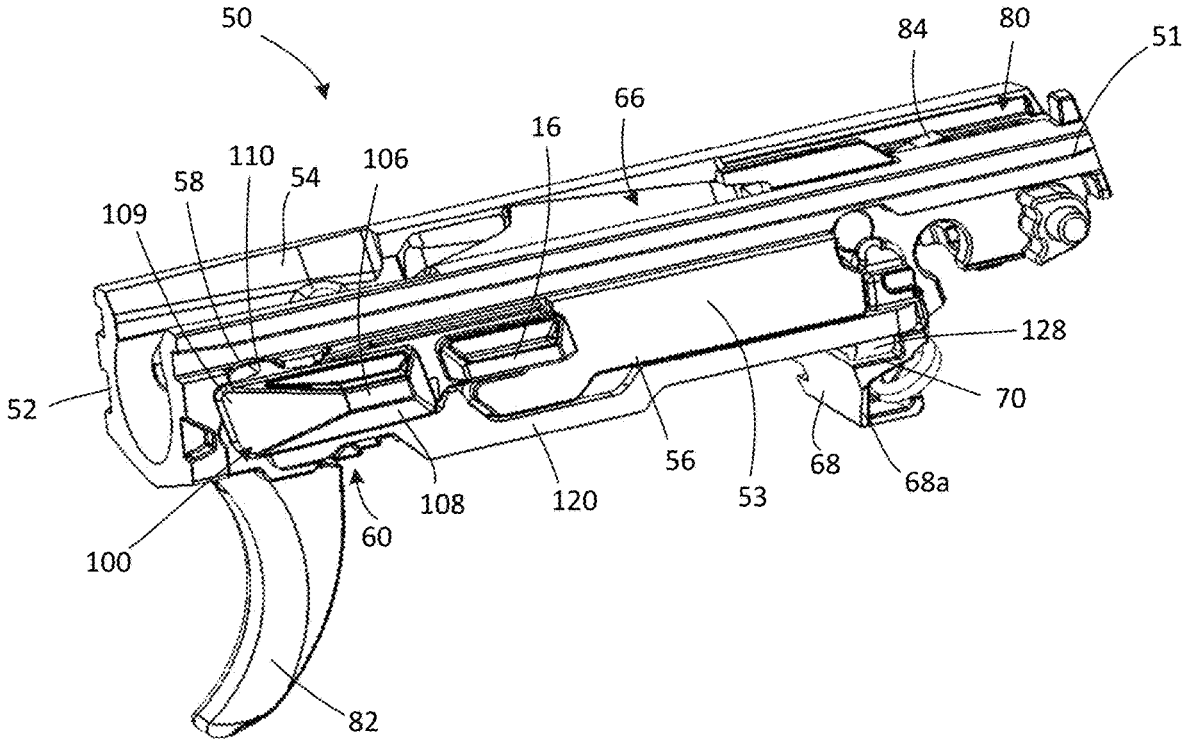
FIG. 4 illustrates a top, front, and left-side perspective view of the frame of FIG. 3 showing the takedown actuation lever in the firing position and portions of the fire control group, in accordance with an embodiment of the present disclosure.

FIG. 4 illustrates a left-side, front, and top perspective view of frame 50 with fire control group 80 and takedown lever assembly 100, in accordance with an embodiment of the present disclosure. In one embodiment, takedown lever assembly 100 includes takedown actuation lever 106 and a safety bar 120. Safety bar 120 extends longitudinally between takedown actuation lever 106 and sear 84 or other component of fire control group 80. Takedown actuation lever 106 is shown in the firing position in FIG. 4.

Frame 50 extends along bore axis 11 from a proximal frame end portion 51 to a distal frame end portion 52. Frame 50 has a left frame wall 53 spaced apart from a right frame wall 54, both of which extend longitudinally on opposite sides of bore axis 11 (shown in FIGS. 1 and 2). Slidelock lever 16 is pivotably attached to left frame wall 53 and is operable to engage the slide when the slide is moved to a rearward position or locking position as shown, for example, in FIG. 2. Frame 50 defines a trigger opening 60 for trigger 82 and a takedown lever opening 58 for takedown lever shaft 110. When assembled, trigger 82 extends into trigger opening 60 and pivots about a trigger pin extending laterally through frame 50, for example. Frame 50 defines an upper magazine well 66 proximal of trigger 82, where upper magazine well 66 is generally associated with the location of an upper end portion of magazine 20, including the magazine follower and/or ammunition when magazine 20 is seated in the magazine well. When magazine 20 is installed in the magazine well in grip portion 24 of grip module 14, such as shown in FIGS. 1-2 for example, ammunition can be fed to a chamber of the barrel 22.

Upper magazine well 66 is bounded proximally by a rear wall 68. Rear wall 68 extends laterally between left frame wall 53 and right frame wall 54 and extends proximally and downwardly from frame 50. In one embodiment, a catch opening 70 extends laterally into rear wall 68 from a wall left side portion 68*a* and is positioned generally below left frame wall 53. Accordingly, catch opening 70 is positioned to permit a protrusion 128 extending laterally from safety bar 120 to pass therethrough when safety bar 120 moves longitudinally. As shown, catch opening 70 is configured as a slot, but can have other configurations consistent with the geometry of safety bar 120 and protrusion 128.

When safety bar 120 is in a proximal position (i.e., rearward position), such as when takedown actuation lever 106 is in the firing position, protrusion 128 extends from safety bar 120 to occupy catch opening 70. In this position, protrusion 128 does not extend distally of rear wall 68 of upper magazine well 66. Accordingly, protrusion 128 does not obstruct entry of magazine 20 to upper magazine well 66. When takedown actuation lever 106 is moved to the takedown position, safety bar 120 moves distally with protrusion 128 positioned to extend into the magazine well, thereby blocking the magazine well from seating magazine 20. Protrusion 128 prevents the user from installing magazine 20, whether loaded or not, into the magazine well when takedown actuation lever 106 is in the takedown position.

Frame 100 defines a takedown lever opening 58 extending laterally therethrough and configured to receive takedown lever shaft 110. In some embodiments, takedown lever opening 58 extends through both of left frame wall 53 and right frame wall 54, where second end 114 of takedown lever shaft 110 is received in takedown lever opening 58 defined in right frame wall 54. It is contemplated that in some embodiments, for example, a corresponding recess in an inside face of right frame wall 108 may be used instead of a through opening in right frame wall 54.

Figure 5:
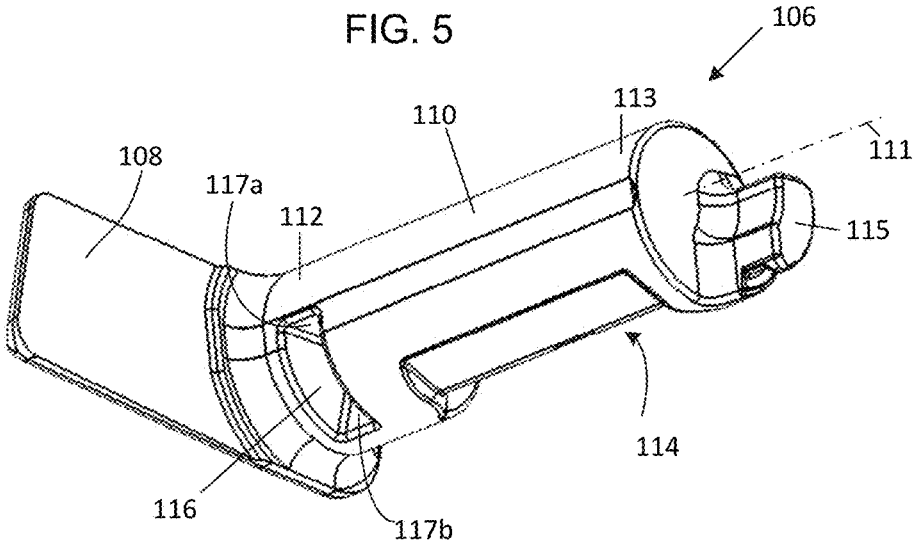
FIG. 5 illustrates a rear, bottom, and right-side perspective view of a takedown actuation lever showing a lateral catch and protrusion extending from the safety bar body, in accordance with an embodiment of the present disclosure.

Referring now to FIG. 5, a bottom, rear, and right-side perspective view illustrates takedown actuation lever 106 in a firing position in accordance with an embodiment of the present disclosure. In one embodiment, takedown actuation lever 106 includes a takedown lever shaft 110 having a generally cylindrical shape that extends along a lever shaft axis 111 from first end 112 to second end 114. Takedown lever wing 108 is attached to and extends transversely (e.g., substantially perpendicularly) from first end 112 of takedown lever shaft 110. Lever wing 108 is configured to be operated by a user to rotate takedown actuation lever 106 about lever shaft axis 144 between the takedown position and the firing position. In the firing position, such as shown in FIGS. 1-5, takedown lever wing 108 extends rearwardly along frame 50 and a portion of grip module 14. In some embodiments, upper distal portion 109 (not visible; shown in FIG. 4) extends distally of takedown lever shaft 110 for interaction with slide 12 and lever wing recess 13 as discussed above.

In some embodiments, takedown lever shaft 110 defines a flat 114 that permits removal of slide 12 in a distal direction when takedown actuation lever 106 is moved to the takedown position. For example, when moved to the takedown position, flat 114 faces upward and provides clearance for slide 12 and its components (e.g., recoil spring assembly) to pass. In the firing position on the other hand, flat 114 faces distally, where the cylindrical shape of takedown lever shaft 110 blocks slide 12 from sliding distally off grip module 14. In some embodiments, a pin tab 115 extends axially from second end 113 of takedown actuation lever 106 to engage right frame wall 54.

Although takedown actuation lever 106 is illustrated as being operable from a left side of the handgun 10, it is contemplated that takedown actuation lever 106 is operable from the left and/or right side of the handgun 10, such as when constructed as a mirror image of takedown actuation lever 106 as illustrated or when takedown actuation lever 106 includes a second lever wing 108 (not shown) on second end 113 for ambidextrous operation.

In some embodiments, takedown lever shaft 110 defines a shaft recess 116 configured to accept a part of safety bar 120. Shaft recess can be a variety of shapes including, for example, a sector shape, an arc, a rectangle, a slot or a bore. In one embodiment, shaft recess 116 has a concavely rounded shape. Shaft recess 116 is constructed to engage safety bar 120 and move safety bar 120 longitudinally when takedown actuation lever 106 is rotated from the firing position to the takedown position (and the reverse, in some embodiments). For example, shaft recess 116 has one or more catch surfaces 117 that engage safety bar 120 upon rotation of takedown actuation lever 106. As illustrated in FIG. 5, for example, shaft recess 116 has a sector shape with two catch surfaces 117 extending at about 90° to each other (e.g., horizontally and vertically). One catch surface 117*a* (extending horizontally as shown in FIG. 5) will engage safety bar 120 when takedown actuation lever 106 is moved to the takedown position. The second catch surface 117*b* (extending vertically as shown in FIG. 5) will engage safety bar 120 when takedown actuation lever 106 is moved from the takedown position to the firing position.

Figure 6A:
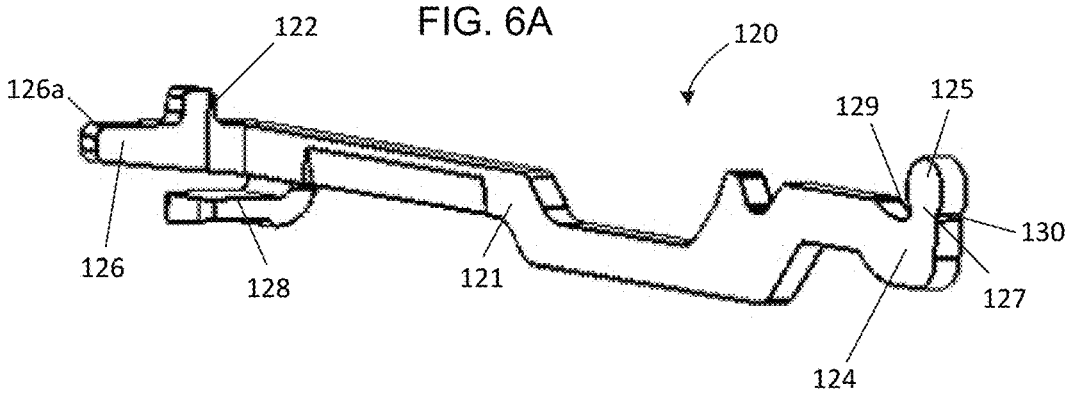
FIG. 6A illustrates a front and right-side perspective view of a safety bar, in accordance with an embodiment of the present disclosure.
Figure 6B:
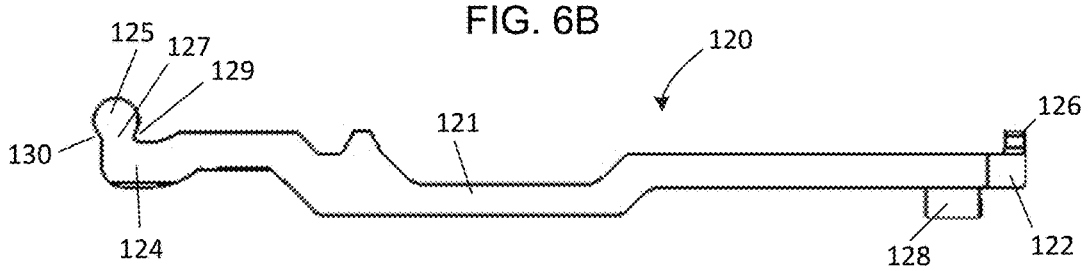
FIG. 6B illustrates a left-side elevational view of the safety bar of FIG. 6A.

Referring now to FIGS. 6A-6B, a right-side, front, and perspective view and a left-side elevational view, respectively, illustrate safety bar 120 in accordance with an embodiment of the present disclosure. In some embodiments, safety bar 120 has a safety bar body 121 that extends longitudinally between proximal safety bar end portion 122 and distal safety bar end portion 124. In some embodiments, safety bar 120 is shaped and configured to move longitudinally along a bottom portion 56 of frame 50. In other embodiments, safety bar 120 can move along an outside surface of left frame wall 53. Proximal safety bar end portion 122 has a lateral catch 126 extending transversely (e.g., ~90°) therefrom. Lateral catch 126 is sized and configured to extend laterally into frame 50 to operably engage a sear 84 or other component of the fire control group 80. When safety bar 120 is moved distally, lateral catch 126 causes sear 84 to disengage from a striker 86 to release striker 86 from spring tension. In some embodiments, lateral catch 126 directly engages sear 84; in other embodiments, lateral catch 126 engages a sear actuator or other component connected to sear 84.

In one embodiment, safety bar body 121 has a generally flat shape with proximal safety lever end portion 122 bent at about 90° to define lateral catch 126 extending laterally about ¼ inch therefrom. For example, safety bar 120 is cut or punched from metal sheet and then lateral catch 126 and protrusion 128 are bent to extend laterally from safety bar body 121. Lateral catch 126 in one embodiment tapers in size towards catch end 126*a*. In other embodiments, catch end 176*a* defines a hook, curl, or other suitable feature appropriate for operating sear 84 by direct or indirect engagement. Safety bar body 121 can have various geometries suitable to interface with frame 50, including notches, bends, turns, recesses, or other features.

In some embodiments, safety bar 120 defines protrusion 128 constructed to extend into the magazine well when takedown actuation lever 106 is in the takedown position. As such, protrusion 128 requires the magazine well to be empty of magazine 20 in order for takedown actuation lever 106 to be moved to the takedown position. In one embodiment, protrusion 128 extends transversely (e.g., laterally at ~90°) from safety bar body 121 and is positioned distally of lateral catch 126. For example, protrusion 128 is a rectangular tab that does not extend into the magazine well when takedown actuation lever 106 is in the firing position, but instead is positioned proximally of the magazine well such as occupying catch opening 70 in rear wall 68 of the magazine well. However, when takedown actuation lever 106 is moved to the takedown position, protrusion 128 is positioned to extend into the magazine well.

In some embodiments, distal safety bar end portion 124 is configured to engage takedown actuation lever 106 to cause movement of safety bar 120 along bore axis 11 when takedown actuation lever 106 is moved between the firing position and the takedown position. For example, distal safety bar end portion 124 defines a head 125 and optional neck 127 extending transversely (e.g., upward) from safety bar body 121. In one set of embodiments, head 125 has an overall greater size than neck 127, where neck 127 is a narrowed section or a region of reduced size between head 125 and safety bar body 121. In some embodiments, head 125 can be circular, hexagonal, square, crescent, or other geometric shape. Head 125 and/or neck 127 can define an inward recess or cove 129 on proximal side of head 125 to engage catch surface 117 of takedown lever shaft 110 when takedown actuation lever 106 is moved from the firing position to the takedown position. For example, cove 129 can be an acute angle or concave recess defined between safety bar body 121 and head 125. Cove 129 can alternately be a notch or the like formed in a proximal portion of head 125 and/or neck 127. Similarly, a distal recess 130 can be defined between a distal portion of head 125 and distal safety bar end portion 124, where distal recess 130 is configured for engagement with catch surface 117 of takedown lever shaft 110 when takedown actuation lever 106 is moved from the takedown position to the firing position. Cove 129 and distal recess 130 are formed so that rotation of takedown actuation lever 106 causes longitudinal movement of safety bar 120.

Figure 7:
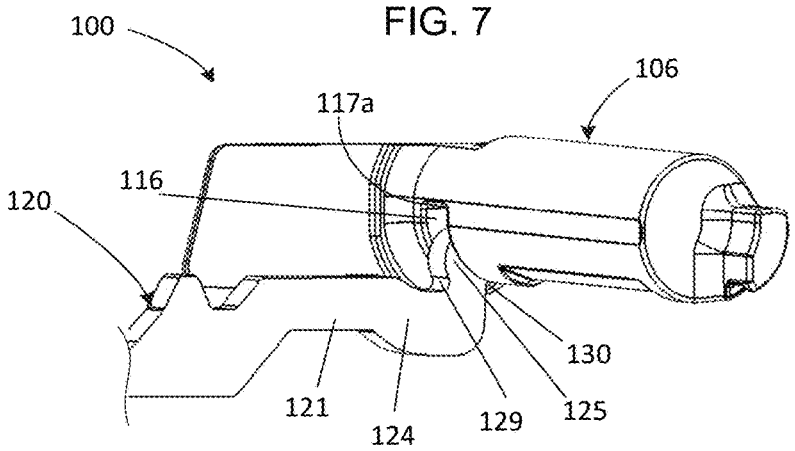
FIG. 7 illustrates a left-side and rear perspective view of a takedown lever assembly in the firing position and shows the head of the safety bar received in a recess of the takedown actuation lever, in accordance with an embodiment of the present disclosure.

Referring now to FIG. 7, a right-side and rear perspective view illustrates takedown actuation lever 106 and distal safety bar end portion 124 of takedown lever assembly 100, where takedown actuation lever 106 is in the firing position. Head 125 is partially received in shaft recess 116 with second catch surface 117*b* abutting or proximate to distal recess 130 (not visible; shown in FIGS. 6A-6B), thereby maintaining and/or having moved safety bar 120 rearwardly. When takedown actuation lever 106 is rotated approximately 90° to the takedown position, first catch surface 117*a* can engage head 125 and cove 129 to move safety bar 120 forward.

Figure 8A:
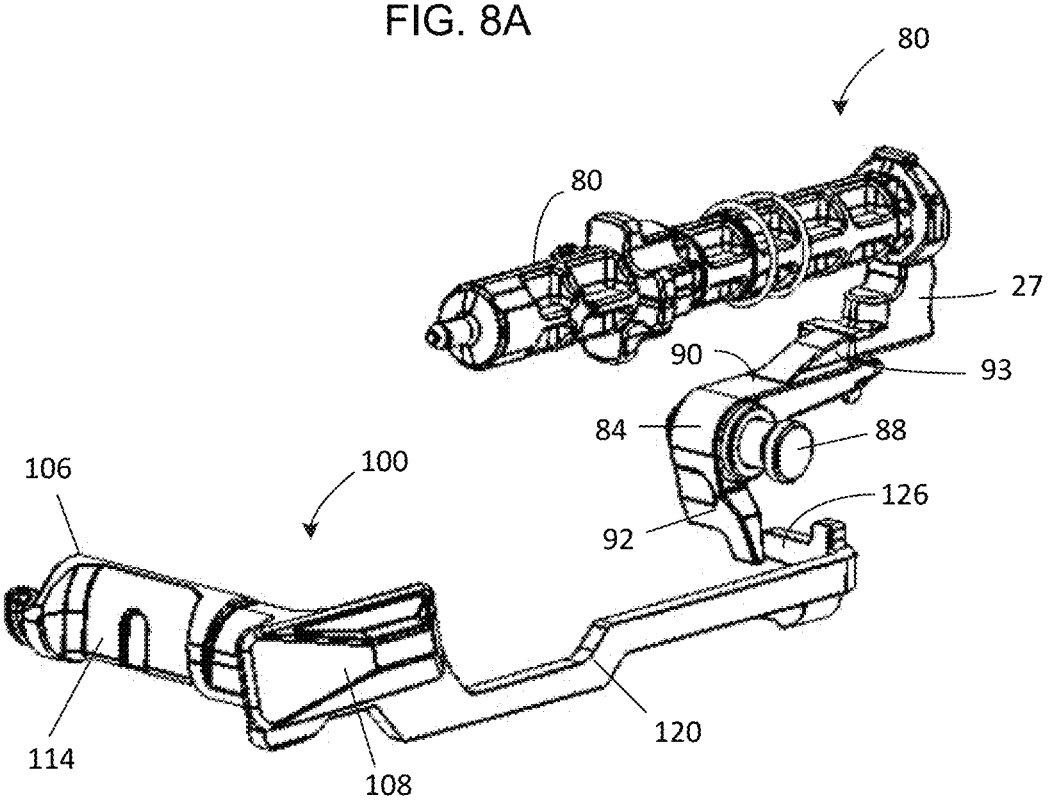
FIG. 8A illustrates a top, front, and left-side perspective view of a takedown lever assembly as well as a sear and striker of the fire control group, in accordance with an embodiment of the present disclosure. The takedown actuation lever is in the firing position with the safety bar in the proximal position with the lateral catch positioned close to the sear. The sear engages the striker and retains the striker in a cocked position.
Figure 8B:
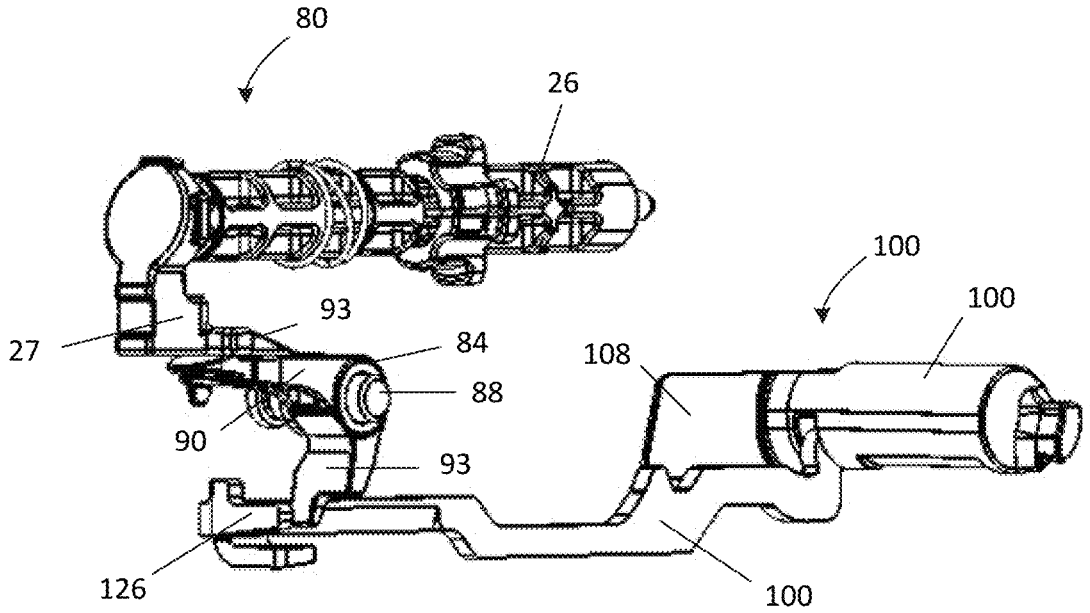
FIG. 8B illustrates a rear and right-side perspective view of the takedown lever assembly, sear, and striker of FIG. 8A. The head of the safety bar is received partially in the recess of the takedown lever shaft.

Referring now to FIGS. 8A and 8B, a front, top, and left-side perspective view and a rear, bottom, and right-side perspective view, respectively, illustrate takedown lever assembly 100 and part of fire control group 80, where takedown actuation lever 106 is in the firing position. Flat 114 faces distally and lever wing 108 extends longitudinally along grip module 14 (shown in FIGS. 1-2). Lateral catch 126 contacts or is positioned to make contact with striker 84. Safety bar 120 extends from takedown actuation lever 106 to sear 84, which is configured to pivot about a sear pivot pin 88. In one embodiment, sear 84 has an L-shape with a horizontal leg 90 and a vertical leg 92. Horizontal leg 90 includes a sear catch surface 93 configured to engage striker 26 and maintain striker 26 under spring tension in a ready-to-fire position. In one embodiment, striker 26 includes a striker leg 27 that extends down from a proximal end portion of striker 26 and is configured to engage sear catch surface 93. Other configurations of sear 84 and striker 26 are contemplated within the scope of the present disclosure, as will be apparent.

Figure 9A:
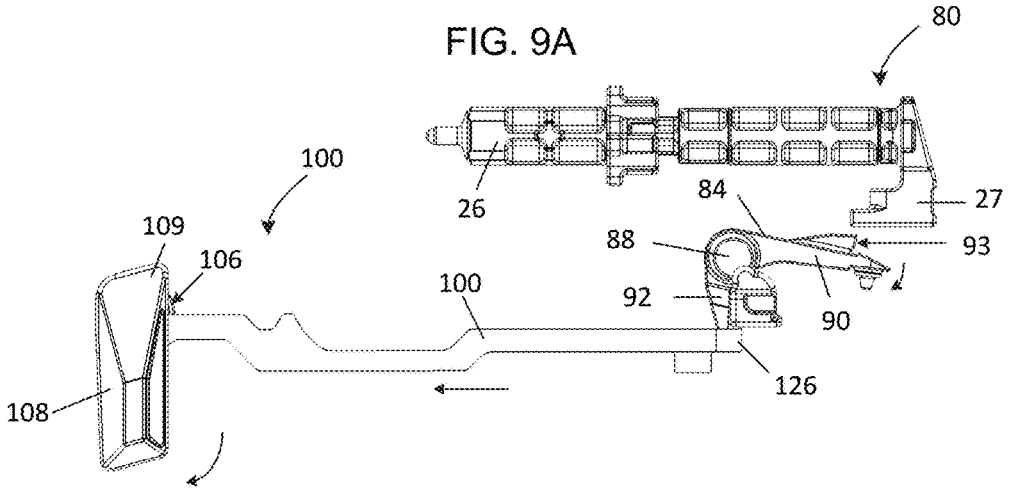
FIG. 9A illustrates a left-side elevational view of the takedown lever assembly, sear, and striker of FIG. 8A, showing the takedown actuation lever in the takedown position with the safety bar displaced distally and the sear rotated out of engagement with the striker, in accordance with an embodiment of the present disclosure.
Figure 9B:
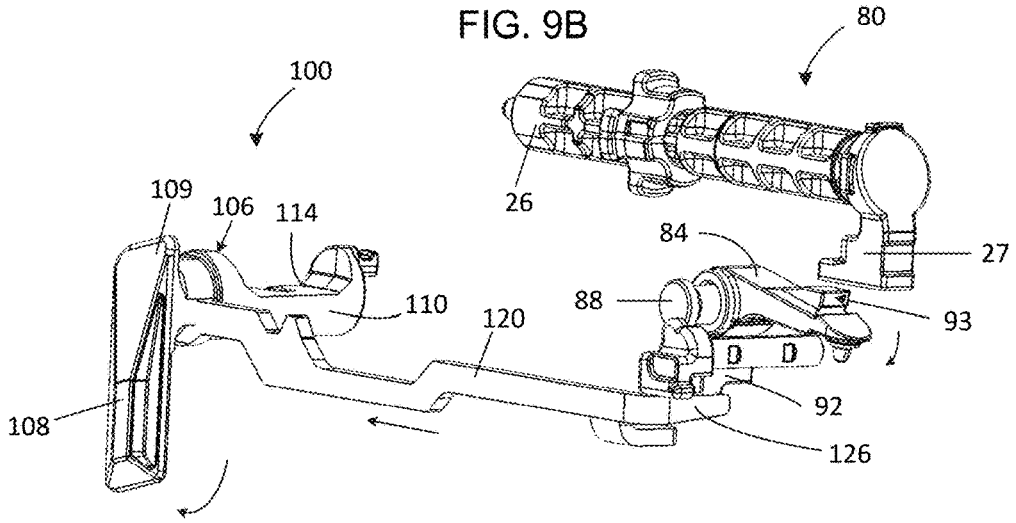
FIG. 9B illustrates a top, rear, and left-side perspective view of the takedown lever assembly, sear, and striker of FIG. 9A.
Figure 9C:
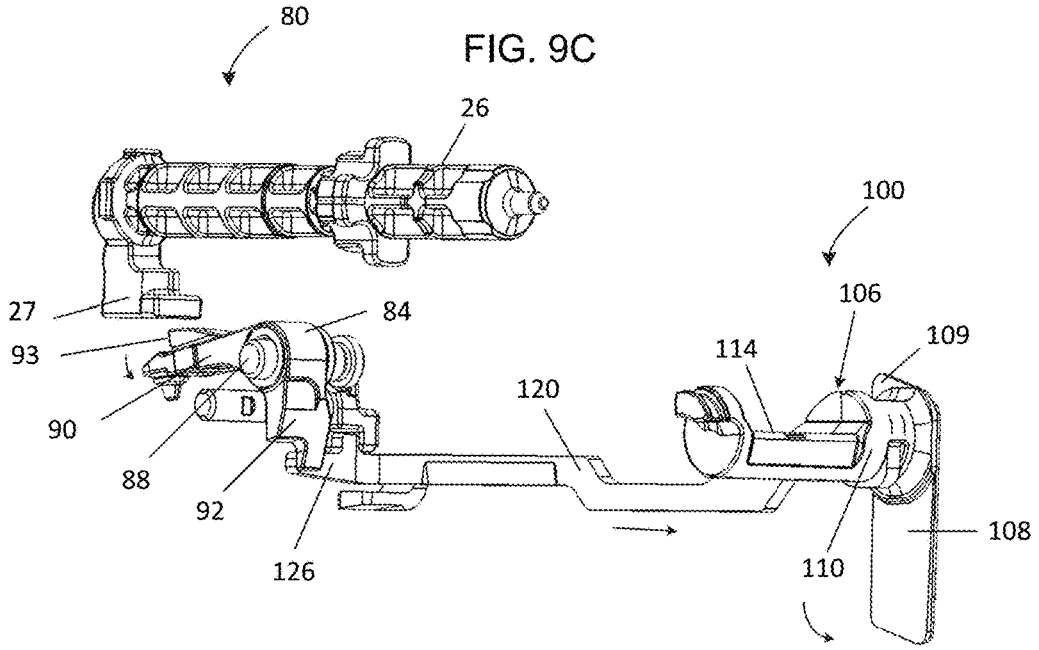
FIG. 9C illustrates a front and right-side perspective view of the takedown lever assembly, sear, and striker of FIG. 9A.

Referring now to FIGS. 9A, 9B, and 9C, a left-side elevational view, a rear, top, and left-side perspective view, and a front, bottom, and right-side perspective view, respectively, illustrate takedown lever assembly 100 and part of fire control group 80, where takedown actuation lever is in the takedown position. In the takedown position, flat 114 faces up to provide clearance for passage of slide 12. Lever wing 108 has been rotated about 90° to a generally vertical orientation with upper distal portion 109 now extending vertically above takedown lever shaft 110. As such, safety bar 120 has been moved distally (i.e., forward) with lateral catch 126 in engagement with sear 84. During distal travel, safety bar pivots sear 84 about sear pivot pin 88 to lower sear catch surface 93, which in turn disengages from striker leg 27 and permits striker 26 to move forward.

Figure 10:
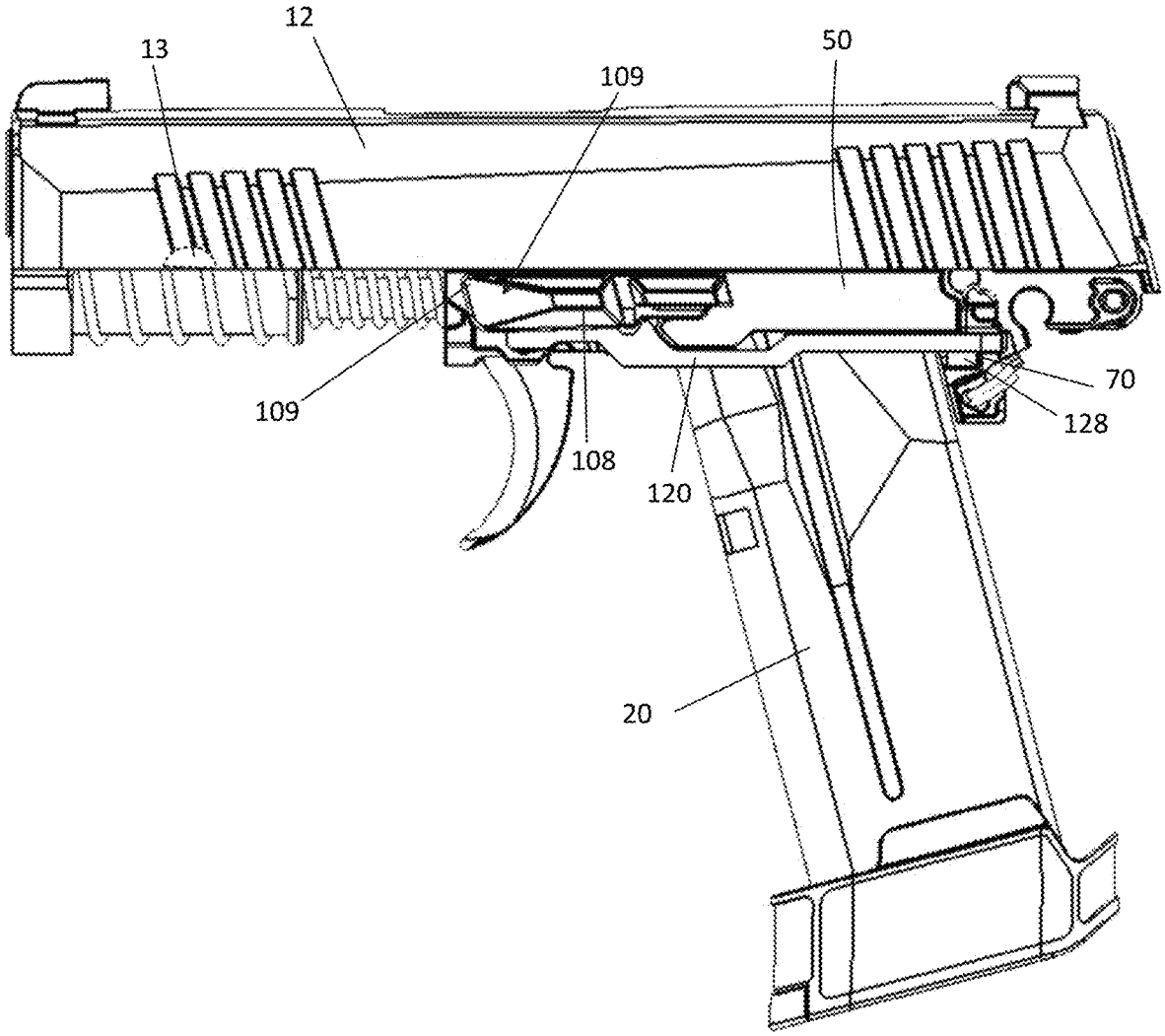
FIG. 10 illustrates a left-side elevational view of the slide assembly, frame, and magazine of the handgun of FIG. 1 showing the takedown actuation lever in the firing position and the protrusion received in a slot defined in a rear wall of the magazine well, in accordance with the present disclosure.
Figure 11:
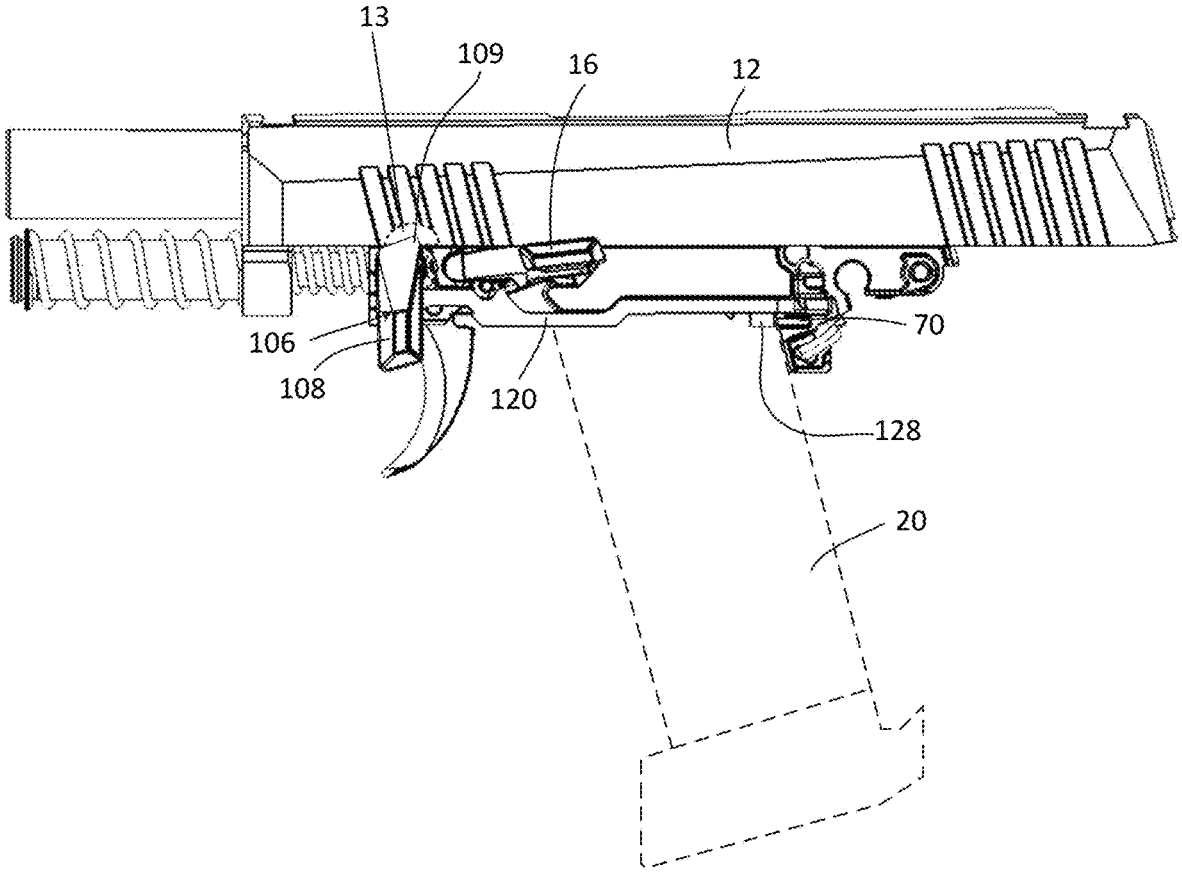
FIG. 11 illustrates a left-side elevational view of the slide assembly and frame of FIG. 10, showing the takedown actuation lever in the takedown position, the safety bar in a distal position, and the protrusion on the safety bar extending into the magazine well, in accordance with an embodiment of the present disclosure. The outline of a magazine is shown in broken lines to represent the position of the magazine relative to the protrusion when the takedown actuation lever is in the takedown position.

Referring now to FIGS. 10 and 11, left-side elevational views illustrate takedown lever assembly 100 in the firing position and the takedown position, respectively, along with frame 50, slide 12, and magazine 20. In FIG. 10, takedown actuation lever is in the firing position as discussed above with reference to FIGS. 8A-8B. Upper distal portion 109 of lever wing 108 is positioned below slide 12 and out of alignment with lever wing recess 13 since slide 12 is in the forward or closed position. Protrusion 128 is positioned proximally (behind) magazine 20 to permit unblocked access of magazine 20 to the magazine well. With magazine 20 seated in the magazine well, handgun 10 is considered not safe for takedown due to a possibly loaded magazine still present in the magazine well. Accordingly, takedown actuation lever 106 is prevented from being moved to the takedown position due to interference between protrusion 128 and magazine 20.

In FIG. 11, slide 12 has been moved to the slidelock position with slidelock lever 16 engaging slide 12 to retain slide 12 in this position against spring forces. Magazine 20 is shown in broken lines to represent its position it would occupy when seated in the magazine well; however, the magazine has been removed for takedown. Lever wing recess 13 is now aligned with upper distal portion 109 of lever wing 108. Takedown actuation lever 106 has been rotated clockwise to the takedown position with upper distal portion 109 rotating through lever wing recess 13 of slide 12. By rotating takedown actuation lever 106 to the takedown position, safety bar 120 has been drawn distally (forward) to disengage sear 84 from striker 26 (shown in FIGS. 9A-9C). Protrusion 128 has also moved distally and now occupies the magazine well, which would not have been possible with magazine 20 still seated in the magazine well due to the interference with protrusion 128. Now that the magazine has been removed from handgun 10, slide 12 has been moved to the slidelock position (ejecting any remaining chambered round), and striker 26 has been released forward after disengaging from sear 84. Accordingly, handgun 10 now is unloaded and the striker 26 is decocked. In this condition, the handgun 10 is in a safe condition to remove slide 12 and commence cleaning or service.

In use, embodiments of takedown lever assembly 100 of the present disclosure advantageously reinforce proper safety protocol when disassembling handgun 10 for cleaning or service, and the subsequent reassembly, by requiring certain conditions be met prior to takedown. In some embodiments, for example, slide 12 must be moved to the slidelock position before takedown actuation lever 106 can be rotated to the takedown position. Moving the slide 12 rearward ejects any round that may be in the chamber. Protrusion 128 on safety bar 120 conflicts with magazine 20 when takedown actuation lever 106 is moved to the takedown position, therefore requiring the absence of magazine 20 in the magazine well. These steps involve unloading handgun 10 prior taking down the handgun. With magazine 20 removed and the chamber empty, takedown actuation lever 106 can be moved to the takedown position in preparation for removing slide 12. This action disengages the sear from the striker and places the action in a decocked position. By following this protocol, handgun 10 is unloaded and striker 26 is decocked, making handgun 10 ready to disassemble for cleaning or service. In effect, some embodiments of takedown lever assembly 100 eliminate any opportunity for the user to inadvertently or intentionally take down handgun 10 without first unloading and then decocking the action. Some embodiments of takedown lever assembly 100 of the present disclosure are unlike some handguns where the user must pull the trigger to release the spring energy on the striker, an action that can be performed while a round is chambered and while a magazine is seated in the magazine well.

Additionally, while takedown actuation lever 106 remains in the takedown position, lateral catch 126 prevents sear 84 from occupying a position in which it could maintain the striker cocked under spring tension and ready for firing. Further, protrusion 128 on safety bar 120 prevents the user from installing magazine 20 in the magazine well while takedown actuation lever 106 is in the takedown position. Thus, during reassembly, takedown lever assembly 100 reinforces both the proper assembling of slide 12 on frame 50 and the moving of takedown actuation lever 106 back to the firing position before inserting a magazine or cocking the action. After following safe protocol and returning takedown actuation lever 106 to the firing position, safety bar 120 permits fire control group 80 to assume a fire-ready position. At this point, magazine 20 can be installed in the magazine well.

As will be appreciated in light of this disclosure, embodiments of takedown lever assembly 100 described herein are not limited to use with striker-fired handguns and may be utilized with hammer-fired handguns and other host firearms, including long guns, short-barreled rifles, and machine guns as will be apparent in light of this disclosure. In some embodiments, takedown lever assembly 100 can be provided assembled with handgun 10 or can be provided separately, such as part of a kit to retrofit existing handguns.

Takedown actuation lever 106, safety bar 120, and other components of handgun 10, may be constructed from any suitable materials as will be apparent in light of this disclosure. For example, some embodiments of takedown actuation lever 106 and safety bar 120 are constructed from steel, polymers, composites, aluminum, or other materials. More generally, takedown actuation lever assembly 100 can be constructed from any suitable material which is compliant, for example, with United States Defense Standard MIL-W-13855 (Weapons: Small Arms and Aircraft Armament Subsystems, General Specification For).

FURTHER EXAMPLE EMBODIMENTS

The following examples pertain to embodiments of the present disclosure, from which numerous permutations and configurations will be apparent.

Example 1 is a takedown lever assembly for a handgun having a grip module, a frame disposed in the grip module, a barrel, a slide displaceable along the frame, and a fire control group with a sear and a striker. The takedown lever assembly comprises a takedown actuation lever operable between a firing position and a takedown position, and a safety bar operatively coupled to the takedown actuation lever. The safety bar moves distally along the frame in response to moving the takedown actuation lever from the firing position to the takedown position, thereby causing the sear to disengage from the striker.

Example 2 includes the subject matter of Example 1, where the safety bar defines a lateral catch extending from a proximal end portion of the safety bar. The lateral catch is configured to engage a component of the fire control group to disengage the sear from the striker when the safety bar moves distally.

Example 3 includes the subject matter of Example 2, where the component is the sear and where the lateral catch pivots the sear out of engagement with the striker when the safety bar moves distally.

Example 4 includes the subject matter of any of Examples 1-3, where the takedown actuation lever comprises a takedown lever shaft extending along a lever shaft axis and is configured to extend laterally through the frame. The takedown lever shaft has a first end portion and a second end portion, where the first end portion defines a recess with at least one catch surface configured to engage a distal end portion of the safety bar. The takedown actuation lever also has a lever wing connected to and extending transversely from an end of the takedown lever shaft.

Example 5 includes the subject matter of Example 4, where the recess has a shape of a sector spanning from 70-100°, wherein the at least one catch surface includes a first catch surface extending generally parallel to the bore axis when the takedown actuation lever is in the firing position Example 6 includes the subject matter of Example 5, where the recess includes a second catch surface extending downward from the first catch surface when the takedown actuation lever is in the firing position, wherein when moving the takedown actuation lever from the takedown position to the firing position, the second catch surface engages the distal end portion of the safety bar to move the safety bar proximally.

Example 7 includes the subject matter of Example 4, where the recess is concave.

Example 8 includes the subject matter of any of Examples 4-7, where the distal end portion of the safety bar includes a neck portion and a head portion, the neck portion extending upward from the safety bar to the head portion, wherein the head portion wherein larger than the neck portion.

Example 9 include the subject matter of Example 8, where the neck portion defines a cove, and wherein the first catch surface engages the cove when moving the takedown actuation lever from the firing position to the takedown position.

Example 10 includes the subject matter of Example 8, where the head portion is sized and shaped to be received at least partially in the recess of the takedown lever shaft.

Example 11 includes the subject matter of any of Examples 1-9, where moving the takedown actuation lever to the takedown position pivots the sear out of engagement with the striker when the striker is in a cocked position, thereby decocking the striker.

Example 12 includes the subject matter any of Examples 1-11, where the safety bar extends longitudinally along the frame and moves distally or proximally in a direction generally parallel to the barrel.

Example 13 includes the subject matter of any of Examples 1-12 and further comprises a protrusion extending laterally from the safety bar, where in the takedown position, the protrusion extends into a magazine well of the handgun, thereby obstructing a magazine from being seated in the magazine well.

Example 14 includes the subject matter of Example 13, where the protrusion is adjacent the proximal end portion of the safety bar, and when the takedown safety lever is in the firing position, the protrusion is positioned outside of the magazine well.

Example 15 includes the subject matter of Example 14, where the frame defines an opening sized to permit passage of the protrusion therethrough when the safety bar moves longitudinally in response to the takedown actuation lever moving between the firing position and the takedown position.

Example 16 includes the subject matter of Example 15, where the opening is defined in a rear wall of the upper portion of the magazine well.

Example 17 includes the subject matter of Example 16, where the opening is a slot in the rear wall of the upper portion of the magazine well.

Example 18 includes the subject matter of any of Examples 15-17, where when the takedown actuation lever is in the firing position, the protrusion occupies the opening.

Example 19 includes the subject matter of any of Examples 1-18, where the takedown actuation lever is obstructed by the slide from moving to the takedown position except when the slide is displaced to a rearward position along the frame.

Example 20 includes the subject matter of Example 19, where the slide defines a lever wing recess that provides clearance for rotation of the takedown actuation lever from the firing position to the takedown position when the slide is in the rearward position.

Example 21 is a retrofit kit for a handgun, the kit comprising the takedown lever assembly of any of Examples 1-20.

Example 22 is a handgun comprising the takedown lever assembly of any of Examples 1-20.

Example 23 includes the subject matter of Example 22, where the handgun is a striker-fired handgun.

Example 24 includes the subject matter of claim 22 or 23, where the handgun is a semiautomatic handgun.

Example 25 is a handgun frame assembly comprising a frame extending along a bore axis from a proximal frame end portion to a distal frame end portion, the frame defining an upper portion of a magazine well and a takedown pin opening extending laterally through the frame; a fire control assembly attached to the frame, the fire control assembly including a trigger, a striker movable along the bore axis between a cocked position and a firing position, and a sear operable between a first position and an second position, wherein the sear is configured to engage and retain the striker in the cocked position until the sear disengages the striker due to pulling the trigger; a takedown actuation lever with a lever shaft extending through the takedown lever opening and having a first end portion, a second end portion, and a lever wing extending transversely from the first end portion for operation by a user, wherein the takedown actuation lever is rotatable about the lever shaft between a firing position and a takedown position; and a safety bar extending longitudinally along the frame and operationally coupled to the takedown actuation lever, the safety bar having a distal end portion and a proximal end portion; where moving the takedown actuation lever from the firing position to the takedown position moves the safety bar distally, thereby causing the sear to disengage from and release the striker when the striker is in the cocked position.

Example 26 includes the subject matter of Example 25, where the lever shaft defines a recess extending radially into the first end portion, and where the recess has a catch surface positioned to engage the distal end portion of the safety bar when the takedown actuation lever is moved from the firing position to the takedown position.

Example 27 includes the subject matter of Example 26, where the catch surface faces down when the takedown actuation lever is in the firing position, and the catch surface faces distally when the takedown actuation lever is in the takedown position.

Example 28 includes the subject matter of Example 27, where the safety bar defines a head portion extending upward from the distal end portion, the head portion configured to be received in the recess and engage the catch surface of the takedown actuation lever when the takedown actuation lever is moved between the firing position and the takedown position, thereby causing the takedown safety lever to move longitudinally along the frame.

Example 29 includes the subject matter of any of Examples 25-27, where the safety bar comprises: a safety bar body extending longitudinally from the distal end portion to the proximal end portion; a head on the distal end portion, the head configured to be received in a recess defined in the lever shaft; and a catch extending laterally from the proximal end portion and configured to operatively engage a component of the fire control group to cause the sear to disengage from the striker when the striker is in the cocked position.

Example 30 includes the subject matter of Example 29, where the catch engages the sear when the takedown actuation lever is moved to the takedown position, thereby rotating the sear out of engagement with the striker.

Example 31 includes the subject matter of Example 29, where the lever head is captured in the recess when the takedown actuation lever is moved to the takedown position.

Example 32 includes the subject matter of any of Examples 25-31 and further comprises a protrusion extending laterally from the safety bar body, where the protrusion extends into the magazine well when the takedown actuation lever is in the takedown position.

Example 33 includes the subject matter of Example 32, where the protrusion is spaced distally from the catch.

Example 34 includes the subject matter of Example 25, where a proximal wall of the magazine well defines a slot configured for passage therethrough of the protrusion when the safety bar moves longitudinally along the frame.

Example 35 includes the subject matter of any of Examples 32-34, where the protrusion is positioned outside of the magazine well when the takedown actuation lever is in the firing position, thereby permitting a magazine to seat in the magazine well.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A takedown lever assembly for a handgun, the handgun having a grip module, a frame disposed in the grip module, and a fire control group with a sear and a striker, the takedown lever assembly comprising:

a takedown actuation lever operable between a firing position and a takedown position, the takedown actuation lever having a lever shaft constructed to extend laterally through the frame, wherein the lever shaft defines a recess with a catch surface;

a safety bar operatively coupled to the takedown actuation lever, the safety bar having a proximal end portion configured to directly contact the sear, and a distal end portion including a head portion configured to be received in the recess and engage the catch surface, wherein the safety bar is configured to be drawn distally along the frame in response to moving the takedown actuation lever from the firing position to the takedown position, thereby causing the sear to disengage from the striker.

2. The takedown lever assembly of claim 1, wherein the proximal end portion of the safety bar includes a lateral catch configured to contact the sear when the safety bar moves distally.

3. The takedown lever assembly of claim 1, wherein the takedown actuation lever further comprises:

a lever wing connected to and extending transversely from at least one end of the lever shaft.

4. The takedown lever assembly of claim 1, wherein the recess has a shape of a sector spanning from 70-100°, wherein the catch surface includes a first catch surface extending generally parallel to the bore axis along a first radial portion of the sector when the takedown actuation lever is in the firing position.

5. The takedown lever assembly of claim 4, wherein the catch surface further includes a second catch surface extending downward along a second radial portion of the sector when the takedown actuation lever is in the firing position.

6. The takedown lever assembly of claim 1, wherein the distal end portion of the safety bar further includes a neck portion extending upward from the safety bar to the head portion, wherein the head portion is larger than the neck portion.

7. The takedown lever assembly of claim 1 further comprising:

a protrusion extending laterally from the safety bar, wherein in the takedown position, the protrusion is configured to extend into a magazine well of the handgun, thereby obstructing a magazine from being seated in the magazine well.

8. The takedown lever assembly of claim 7, wherein the protrusion is adjacent the proximal end portion of the safety bar, and when the takedown safety lever is in the firing position, the protrusion is configured to be positioned outside of the magazine well.

9. The takedown lever assembly of claim 8 further comprising a frame, wherein the frame defines an opening in a rear wall of the upper portion of the magazine well, the opening sized to of receive the protrusion when the takedown lever is in the firing position.

10. The takedown lever assembly of claim 9, wherein the opening is a slot in the rear wall of the upper portion of the magazine well.

11. The takedown lever assembly of claim 9, wherein when the takedown actuation lever is in the firing position, the protrusion occupies the opening.

12. A handgun frame assembly comprising:

a frame extending along a bore axis from a proximal frame end portion to a distal frame end portion, the frame defining an upper portion of a magazine well and a takedown pin opening extending laterally through the frame;

a fire control assembly attached to the frame, the fire control assembly including a trigger, a striker movable along the bore axis between a cocked position and a firing position, and a sear operable between a first position and a second position, wherein the sear is configured to engage and retain the striker in the cocked position until the sear disengages from the striker due to pulling the trigger;

a takedown actuation lever with a lever shaft extending through the takedown lever opening and having a first end portion, a second end portion, and a lever wing extending transversely from the first end portion for operation by a user, the lever shaft defining a recess with a catch surface, wherein the takedown actuation lever is rotatable about the lever shaft between a firing position and a takedown position; and a safety bar extending longitudinally along the frame and operationally coupled to the takedown actuation lever, the safety bar having a distal end portion and a proximal end portion, the distal end portion including a head portion extending up from the safety bar and configured to be received in the recess in the lever shaft, wherein when moving the takedown actuation lever from the firing position to the takedown position the catch surface engages the head portion and moves the safety bar distally, thereby disengaging the sear from the striker when the striker is in the cocked position.

13. The handgun frame assembly of claim 12, wherein the safety bar includes a laterally-extending protrusion and wherein a proximal wall of the magazine well defines a slot configured to receive the protrusion, wherein when the takedown actuation lever is in the takedown position the protrusion extends into the magazine well and obstructs a magazine from being seated in the magazine well.

14. The handgun frame assembly of claim 12, wherein the recess generally has a wedge shape with a vertex extending radially into the first end portion of the lever shaft, wherein the catch surface engages the head portion of the safety bar when the takedown actuation lever is moved from the firing position to the takedown position.

15. The handgun frame assembly of claim 12, wherein the catch surface extends radially and faces down when the takedown actuation lever is in the firing position, and the catch surface faces distally when the takedown actuation lever is in the takedown position.

16. The handgun frame assembly of claim 12, wherein the safety bar includes a laterally-extending catch that contacts and pivots the sear when the takedown actuation lever is moved to the takedown position.

17. The handgun frame assembly of claim 16, further comprising a protrusion extending laterally from the safety bar body, wherein the protrusion extends into the magazine well to obstruct a magazine from being seated in the magazine well when the takedown actuation lever is in the takedown position.

18. The handgun frame assembly of claim 17, wherein the protrusion is spaced distally from the catch.

19. The handgun frame assembly of claim 17, wherein the protrusion is positioned outside of the magazine well when the takedown actuation lever is in the firing position, thereby permitting a magazine to seat in the magazine well.

20. A handgun with a takedown lever assembly, a frame, and a fire control group that includes a sear and a striker, the takedown lever assembly comprising:

a takedown actuation lever operable between a firing position and a takedown position, the takedown actuation lever including a lever shaft extending laterally through the frame, the lever shaft defining a recess having a catch surface positioned to engage the distal end portion of the safety bar when the takedown actuation lever is moved from the firing position to the takedown position; and a safety bar operatively coupled to the takedown actuation lever and extending along a side of the frame, a distal end portion of the safety bar including a head portion extending upward from the safety bar and received in the recess, the safety bar further including a proximal end portion configured to directly engage the sear;

wherein the catch surface engages the head portion and draws the safety bar distally along the frame in response to moving the takedown actuation lever from the firing position to the takedown position, thereby disengaging the sear from the striker.

21. The handgun of claim 20, wherein the proximal end portion of the safety bar includes a catch extending laterally, and wherein the catch contacts the sear and pivots the sear out of engagement with the striker when the takedown actuation lever is moved to the takedown position.

22. The handgun of claim 20, further comprising a tab extending laterally from the safety bar, wherein the tab extends into a magazine well of the handgun to obstruct a magazine from being seated in the magazine well when the takedown actuation lever is in the takedown position.

* * * * *